United States Patent [19]

Kaminskas

[11] 4,224,819

[45] Sep. 30, 1980

[54] INTERNAL GASEOUS FLUID STRIPPER FOR CAN BODYMAKERS AND THE LIKE

[75] Inventor: Rimvydas A. Kaminskas, Palos Verdes Estates, Calif.

[73] Assignee: Standun, Inc., Compton, Calif.

[21] Appl. No.: 961,878

[22] Filed: Nov. 17, 1978

Related U.S. Application Data

[62] Division of Ser. No. 692,505, Jun. 3, 1976, Pat. No. 4,164,860.

[51] Int. Cl.[3] ..... B21D 45/00

[52] U.S. Cl. ..... 72/345; 72/349; 72/427

[58] Field of Search ..... 72/344, 345, 346, 349, 72/427; 113/120 H

[56] References Cited

U.S. PATENT DOCUMENTS

| | | | |
|---|---|---|---|
| 3,572,271 | 3/1971 | Fraze | 113/120 H |
| 3,577,753 | 5/1971 | Shal | 72/349 |
| 3,593,552 | 7/1971 | Fraze | 113/120 H X |
| 3,771,344 | 11/1973 | Wright | 72/345 |

*Primary Examiner*—Leon Gilden
*Attorney, Agent, or Firm*—Mahoney & Schick

[57] ABSTRACT

A reciprocal ram at commencement of a forward strokes engages a cup-shaped article carrying it through metal working dies and against a doming die at reversal into a rearward stroke immediately followed by stripping of the article from the ram. The ram has an internal chamber constantly fed pressurized air through a rearward restricted orifice, the chamber opening freely of the ram forward end portion and internally of the article when thereon. By preselecting orifice size, chamber and article volumes matched with air pressure, a predetermined volume of air at predetermined pressure is confined in the ram forwardly against the article immediately prior to stripping and preferably engagement of the article by an external stripper results in an internal stripping assist by the confined pressurized air, the increasing exposed volume of the article increasing the air confinement volume reducing the air pressure progressively to substantially atmospheric at completion of article stripping. For particularly difficult article stripping, a forwardly open and rearwardly closed check valve may be positioned intermediate the ram chamber causing increased air pressure forwardly of the check valve through reduction of contained volume caused by the article doming operation, the increased air pressure giving an initial stripping boost during article stripping.

26 Claims, 13 Drawing Figures

30
32
22
46
36
34
42
54
62
60
52
72
68
66
56
58
48
50
64
70
78
74
76
80

INTERNAL GASEOUS FLUID STRIPPER FOR CAN BODYMAKERS AND THE LIKE

This is a division of application Ser. No. 692,505 filed June 3, 1976, now U.S. Pat. No. 4,164,860.

BACKGROUND OF THE INVENTION

This invention relates to an internal gaseous fluid stripper for use in stripping cup-shaped articles from reciprocal rams after metal working operations have been performed on the articles. Furthermore, one of the principal uses of the internal gaseous fluid stripper concept of the present invention is in can bodymakers and the like, preferably in conjunction with a conventional external stripper. Basically, the internal stripper concept of the present invention involves the confinement within the ram prior to stripping of a predetermined volume of gas, such as air, at a predetermined pressure markedly above atmospheric pressure and freely forward flow communicating and retained in such confinement by the finished article to be stripped. Thus, as article stripping commences and ultimately proceeds to complete stripping, increasingly exposed internal volume of the article adds to the ram chamber volume permitting the confined gas to progressively expand and reduce in pressure with the initial ram chamber volume and gas pressure being predetermined relative to the finished article internal volume such that the gas mutually contained by the ram chamber and article, will continuously exert internal stripping pressure above atmospheric pressure against the article throughout the stripping operation, but will be reduced substantially to atmospheric pressure at the instant of completion of stripping. The overall result is an efficient stripping operation without collapsing or bulging the finished article during stripping even though the finished article may be quite thin-walled.

Various types of metallic cup-shaped articles have been formed by use of reciprocal rams carrying a cup-shaped article through die assemblies and ultimately requiring stripping removal from the ram after the die metal working operations are complete. A prime example thereof in modern manufacturing is the forming of thin-walled metallic can bodies as performed by modern can bodymakers. The finished can so formed is of so called two piece structure, that is, integral side and bottom walls which is ultimately closed by a top wall after filling, the one piece can side and bottom wall being termed a can body.

The first stage of forming can bodies is to blank a circular disc from sheet or strip metal followed by a first drawing operation resulting in a relatively shallow and relatively large diameter metallic cup having a wall thickness in the order of twelve to fourteen thousandths of an inch. The cup is then appropriately fed into a bodymaker wherein it is engaged by and over the end portion of a reciprocal ram just starting a forward stroke in reciprocal ram movement. During ram forward stroke, the can body is carried through a series of dies during which the can body is subjected possibly to redrawing, but at least multiple stages of wall ironing resulting in a smaller diameter, relatively deep cup-shape with a wall thickness in the order of four thousandths of an inch. At forward termination of the ram forward stroke and immediately following exiting from the wall ironing dies, the cup is forced against a bottom forming or doming die where the can bottom wall is reformed and shortly after reversal of ram movement into the ram rearward stroke, the open end of the cup side wall is engaged to essentially halt motion of the cup with continued rearward stroke motion of the ram stripping the cup therefrom.

With the increasing sophistication of can bodymakers generally operating in the manner described, production rates can be maintained in the order of one hundred-twenty to one hundred-fifty cycles per minute or combined ram forward and rearward strokes per minute. These relatively high speeds considered with the final can body extremely thin-wall thicknesses due to advances in die design have necessitated something beyond the above described mere external engagement of the can body, the use of an external stripper, in order to successfully strip the can body from the ram without undue damage to the thin side walls thereof. Thus, an internal stripping assist has been required to augment the external stripper with this internal stripping assist most usually consisting of a mechanically actuated and operable internal plunger within the confines of the ram and internally engaging the can body bottom wall. In other words, the internal stripping assist plunger is normally in a retracted position internally of the ram during the major portion of the ram reciprocal movement, but is timed for mechanical actuation to an extended position against the can body bottom wall and urging the can body from the ram at the precise moment that the external stripper is operable to engage the side walls at the can body open end.

With the extremely high ram speeds and the continuous ram movement, it can be seen that the provision of these mechanically actuated plunger-type of internal stripping assist have been necessarily quite complex and expensive to provide. Even with the ram speed at the lower production rate of one hundred-twenty can bodies per minute, this means that at least two or more can body stripping operations are performed per second and it is obvious that sophisticated timing is involved for coordinating the internal stripping assist movement of the mechanically actuated plunger with the external stripper operation, all of which is subject to wear requiring frequent maintenance refurbishment. In addition, a free internal air venting through the ram must be provided for the interior of the finished can body during stripping so as to eliminate the drawing of a vacuum within the can body during such stripping, such a vacuum not only being capable of inhibiting the relative stripping movement of the can body from the ram, but also causing a collapse of the thin-walled can body which would result in a scrap product.

Various prior attempts have been made to eliminate this relatively complex and expensive mechanically actuated plunger for internal stripping assist and replacement of the same merely with air under pressure. A stream of air under relatively high pressure in the order of ninety to one hundred pounds per square inch was provided internally of the ram and timed valve controlled to be opened against the bottom wall of the can body at the exact instant of can body engagement by the external stripper with the high pressure air stream continuing to flow throughout the stripping motion. Such attempts, however, were quickly abandoned in view of the fact that even though the force produced by the high pressure air stream at the instant of initiation of the stripping motion in order to "break" the can body from the ram to start the relative motion therebetween for such stripping, upon the almost instantaneously following completion of the stripping motion still with the internal force of the high pressure air stream caused the can body to "pop" from the ram with a considerable rearward force. The can body, therefore, exited the ram nearly as a projectal striking the doming die which it had just left so as to not only damage the can body beyond any possible use and very possibly damage the doming die requiring replacement, but otherwise presenting an extremely dangerous situation. If the air pressure was reduced sufficiently low to eliminate the "pop", then there was no force to give any stripping assist.

In an attempt to modify this air injection form of internal stripping assist to a usable form, one prior construction has made use of the same high pressure air stream internally of the ram and directed at the bottom wall of the can body, but has added thereto a valve plunger normally urged to a closed position and otherwise controlled by the bottom wall of the particular can body. In its closed position, the valve plunger extends to the bottom wall of the can body prior to bottom wall doming, thereby retaining the high pressure air stream in a closed condition throughout can body wall ironing and until the doming die is contacted at the end of the ram forward stroke. Doming of the can body by the doming die forms a recess in the can body bottom wall and during the formation of this recess, the bottom wall forces the valve plunger rearwardly within the ram to cause opening of the high pressure air stream, now directly against the can body bottom wall. As the external stripper begins the stripping action providing the opposite relative motion between the can body and the ram, as soon as the can body has been stripped from the ram the very slight doming recess distance, the valve plunger is no longer held in open position by the can body bottom wall and is permitted to move to its normally urged closed position cutting off the high pressure air stream. This means that the high pressure air is directed into the can body against the bottom wall thereof only for the very initial portion of the stripping motion and further supply thereof is then immediately sealed off.

Although this latter prior construction of internal air insertion for stripping assist does eliminate the previous problem of causing the can body to "pop" from the ram with the consequent damages and dangers involved, it still presents many prohibitive deficiencies. One very serious deficiency is that in controlling the high pressure air stream dependent on the use of the can body bottom wall, the stripping assist is only applicable to aiding in the initial breaking loose of the can body from the ram in the initiation of the relative stripping motion and for a very short period thereafter. Since the flow of pressurized air is closed off so quickly, there is not sufficient volume of air entering the can body despite the high pressure thereof to maintain a stripping assist force by the air in the latter stages of the can body stripping.

This not only eliminates completely any internal stripping assist during these latter stages of stripping, but as soon as the internal air pressure in the can body reduces to atmospheric and continues reducing therebeneath as a consequence of the steadily increasing exposed internal volume of the can body, a vacuum is drawn within the can body. As stated in the foregoing, creation of a vacuum within the can body during the stripping motion can both inhibit the stripping action and cause a collapse of the can body to damage the same beyond use. The collapse of the can body is a particularly present danger where the can body metal wall thicknesses are of the low amounts involved in order of four thousandths of an inch as produced by modern can bodymakers. Furthermore, even if the can body wall thicknesses were of sufficient strength to withstand the vacuum drawn, with the control of the volume of air being inserted being dependent on the particular doming recess in the can body bottom wall, it is apparent that this prior construction of internal stripping assist is greatly limited by the particular can body design as to the exact shape of the finished bottom wall thereof.

OBJECTS AND SUMMARY OF THE INVENTION

It is, therefore, an object of this invention to provide an internal gaseous fluid stripper for use in stripping cup-shaped articles from reciprocal rams after metalworking operations have been performed on such articles wherein the internal gaseous fluid stripper eliminates the difficulties and disadvantages of the prior internal stripper constructions. According to the principles of the present invention, a volume of pressurized gas is generally confined internally within the ram at least just prior to the required article stripping operation, such pressurized gas being retained in confinement by the article over the ram end portion. Then, during the movement of the article relative to the ram during the article stripping, the pressurized gas freely distributes between its original ram confinement and progressively greater exposed internal volume portions of the article ultimately resulting in a maximum confined volume for the gas at the instant of complete stripping of the article from the ram. By originally properly proportioning the gas original confined volume and pressure prior to stripping, the gas pressure being markedly above atmospheric pressure, and all related to the internal volume of the article being stripped, a positive pressure above atmospheric may be maintained by the gas substantially throughout the stripping action and so that the confined gas pressure at the instant of complete stripping is not substantially below atmospheric pressure.

It is a further object of this invention to provide an internal gaseous fluid stripper of the foregoing general character which positively eliminates the danger of collapse of the article during the stripping operation. As hereinbefore discussed, during the stripping of cup-shaped articles from a ram, particularly where the article walls are of relatively slight thickness, if any appreciable vacuum is drawn within the article during the stripping operation, there is a distinct danger of collapsing the article. However, by adherence to the principles of the present invention, this danger of a vacuum being drawn can be quite easily positively controlled. With the simple proper selection and proportioning of the confined gas pressure and respective volumes, the internal gas pressure within the article at the instant of complete stripping can be predetermined to be virtually any pressure desired and particularly never substantially below atmospheric pressure, thereby eliminating the article vacuum collapse dangers.

It is still a further object of this invention to provide an internal gaseous fluid stripper of the foregoing general character wherein ejection or "pop" of the article from the ram at the instant of complete stripping can likewise be easily strictly controlled. Through the same considerations as previously discussed, the internal gas pressure within the article at the instant of complete stripping can likewise be controlled to any reasonable amount above atmospheric found to be desirable. Although probably in most instances, a final internal pressure of substantially atmospheric pressure would be most desirable, if pressures above atmospheric were found to be advantageous to provide a controlled range of ejection of the article from the ram during the stripping operation, it is easily possible merely by the correct adjustment of the various value factors, an obvious versatility advantage of the unique present invention.

It is also an object of the present invention to provide an internal gaseous fluid stripper of the foregoing general character which may be presented in a special embodiment form which incorporates an initial "break" force against the article at the initiating of the relative stripping movement between the article and the ram, such initial "break" force being of a controlled increased magnitude but only for a strictly controlled portion of the overall article stripping and with the gas pressure at the instant of complete stripping still being controlled to the amount desired, usually approaching or substantially at atmospheric pressure. This feature of the present invention is particularly advantageous where the article is formed from metals which result in a finished article presenting a higher degree of difficulty during stripping in order to accomplish such stripping. Furthermore, this feature of the present invention is particularly applicable to the formation of cup-shaped articles having a series of metalworking operations performed thereon, the last of which is a doming operation wherein the end wall of the article is formed from a generally radially extending or flat position to an inwardly recessed position, all to be hereinafter explained more in detail.

It is still an additional object of this invention to provide an internal gaseous fluid stripper of the foregoing general character and adaptable to all of the foregoing advantages, but which may still be of a quite simple form involving a minimum of fabrication expense and operable over a long period of useful life with virtually no maintenance required. In the first of the preferred embodiments of the present invention, the basic element necessary to provide is the pressurized gas confinement cavity or void internally of the ram freely forwardly communicable through the end portion of the ram and thereby freely against the inner confines of the article end wall. In maximum simplified form, the injection or admittance of pressurized gas, such as air, to the ram confining cavity may be merely a controlled size orifice receiving pressurized gas on a constant flow basis and slowly admitting the same into the ram cavity for the predetermined cavity gas pressure to be built up during ram movement prior to stripping and ready at proper retained pressure at the moment of initial stripping movement. In such event, the internal gaseous fluid stripper is provided without the use of any moving parts. In the case of the special embodiment of the present invention hereinbefore discussed, the only further addition required is a simple check valve within the ram cavity admitting pressurized gas therethrough freely forwardly but preventing pressurized gas flow rearwardly so that even in this slightly more complex special form, an extremely simplified check valve would be the only movable element.

Other objects and advantages of the invention will be apparent from the following specification and the accompanying drawings which are for the purpose of illustration only.

DESCRIPTION OF THE BEST EMBODIMENTS CONTEMPLATED

As hereinbefore pointed out, the internal gaseous fluid stripper principles of the present invention are generally applicable for use in stripping cup-shaped articles from reciprocal rams after metal-working operations have been performed on such articles, the various applications being fully contemplated according to the principles of the present invention. However, one application thereof which is particularly appropriate is as a stripping assist for modern can bodymakers in the stripping of quite thin-walled can bodies from bodymaker high speed, reciprocal rams. It is in this environment that the internal gaseous fluid stripper principles of the present invention are herein illustrated and described.

Figure 1:
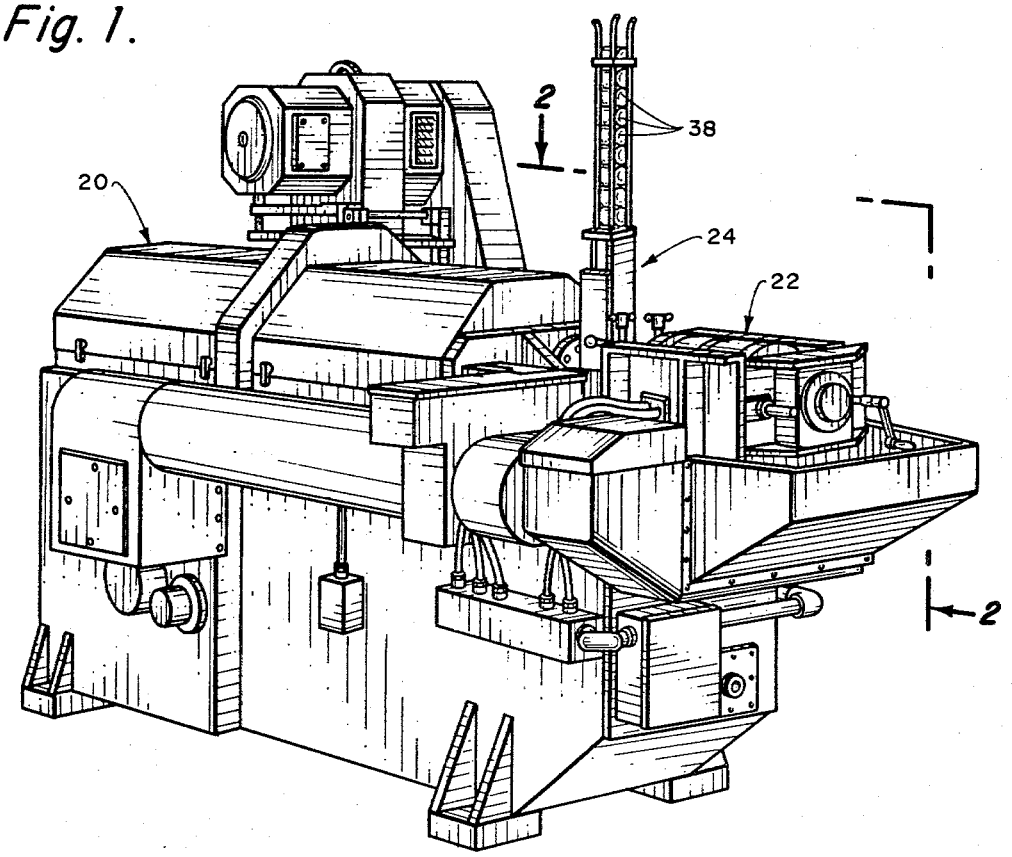
FIG. 1 is a perspective view of a typical metallic can bodymaker incorporating the internal gaseous fluid stripper principles of the present invention.
Figure 2:
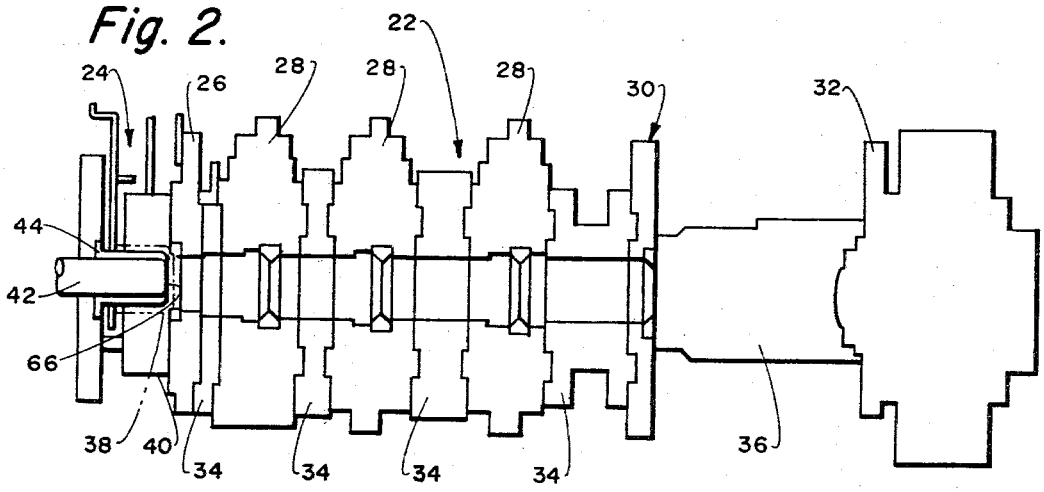
FIG. 2 is an enlarged, fragmentary somewhat diagrammatic vertical sectional view looking in the direction of the arrows 2—2 in FIG. 1 and showing the tool pack of the can bodymaker of FIG. 1 with the bodymaker ram at the initial portion of its forward stroke just engaging a can cup.
Figures 3, 4, 5:
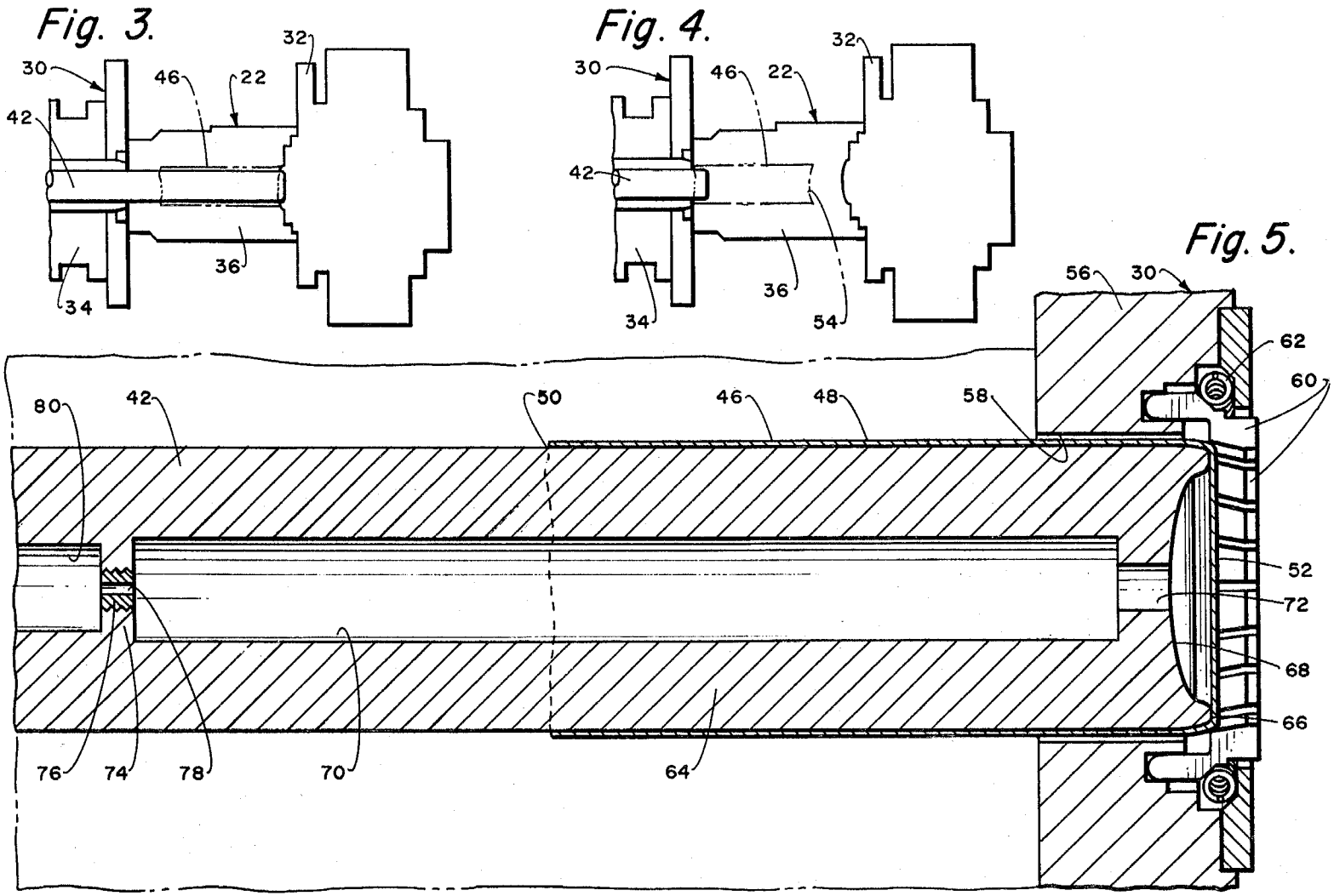
FIGS. 3 and 4 are views similar to FIG. 2 illustrating progressive positions of the ram with a can body being completed and then stripped therefrom.
FIG. 5 is an enlarged, fragmentary, vertical sectional view of the forward end portion of the ram with a wall ironed can body thereon prior to the doming operation, the ram incorporating a first preferred embodiment of the internal gaseous fluid stripper of the present invention and being positioned in its forward stroke beginning to carry the now wall ironed can body through the external stripper.

Initially referring to FIGS. 1 through 4, a typical modern, high speed, metallic can bodymaker is shown in FIG. 1 and includes a ram drive assembly generally indicated at 20, a die pack generally indicated at 22 and a cup feed assembly generally indicated at 24. More specifically as shown in FIGS. 2, 3 and 4, the die pack 22, for purposes of example herein, includes a redraw die ring 26, a series of wall ironing rings 28, a typical external stripper generally indicated at 30 and a doming or end or bottom forming die 32, all positioned with usual spacers 34 and frame 36. With the exception of the incorporation therein of the internal gaseous fluid stripper principles of the present invention, the can bodymaker is of typical construction, not a part of the present invention, and is formed of usual materials satisfactory for the intended purposes and by usual manufacturing procedures, all well known to those skilled in the art.

Generally, still for purposes of environment of the principles of the present invention in a typical operating cycle of the bodymaker, preformed, relatively shallow, metal can cups 38 of aluminimum tinplate, blackplate or similar appropriate materials are fed downwardly, one at a time, in the cup feed assembly 24 to a part positioning yoke 40 (FIG. 2) while an axially reciprocal ram 42 driven by the ram drive assembly 20 is in a withdrawn position to the left of the part positioning yoke 40 just completing the ram rearward or return stroke and beginning the ram forward or working stroke. Prior to the ram 42 reaching the stage of its forward stroke shown in FIG. 2, a redraw blankholder 44 axially enters the open end of the cup 38 then positioned in the part positioning yoke 40 and forces the closed end of the cup against the redraw die ring 26 of the die pack 22 positioning the cup exactly axially aligned with the redraw die ring and the path of axial movement of the ram 42. Immediately thereafter, the ram 42 starting its forward working stroke moving axially to the right as shown in FIG. 2 enters the redraw blankholder 44 and the cup 38 retained position thereby engaging the closed end of the cup and beginning the redrawing and wall ironing operation in the forward working stroke of the ram.

With the ram 42 continuing its forward working stroke bearing axially against the closed end of the cup 38, it carries the particular cup 38 progressively through the redraw die ring 26 and the successive wall ironing rings 28, relatively freely through the external stripper 30 as will be hereinafter explained more in detail and axially against the doming or bottom forming die 32 to the position shown in FIG. 3. This results in the shallow, larger diameter cup 38 being reduced in metal thickness from in the order of twelve to fourteen thousandths of an inch down to in the order of four thousandths of an inch, reduced in diameter to tightly grip the end portion of the ram 42 and increase very significantly in length so as to now constitute a relatively thin-walled and relatively deep final can body 46. After leaving the last of the wall ironing rings 28 and prior to actually being axially forced against the doming die 32, however, the can body 46, although having a finished side wall 48 terminating rearwardly in a somewhat irregular open end 50, has a flat, semi-finished bottom or end wall 52 ultimately formed by the doming die 32 into a recessed, finished bottom or end wall 54, all to be discussed hereinafter more in detail.

Thus, the forcing of the can body 46 against the doming die 32 converts the flat, semi-finished bottom wall 52 into the recessed, finished bottom wall 54 and completes the forward working stroke of the ram 42, the ram reversing axially and beginning its rearward return stroke or to the left as shown in FIG. 3. Following, as shown in FIG. 4, the ram 42 progresses in its rearward stroke moving axially away from the doming die 32 carrying the can body 46 and as will be hereinafter also explained more in detail, but for the moment, assuming only the external stripper 30, as the open end 50 of the can body side wall 48 engages the external stripper 30 axially stopping the can body 46 while the ram 42 continues rearward axial movement, the can body is stripped from the ram. Upon complete disengagement or release of the can body 46 from the ram 42, the can body drops therefrom axially between the external stripper 30 and the doming die 32 to be picked up by usual conveyor means (not shown) and transported away from the can bodymaker to have final manufacturing operations performed thereon including trimming of the can body side wall 48 to exact final length.

So as to more completely appreciate the magnitude of the problems solved by the improvements of the present invention, it should be kept in mind that a modern can bodymaker of the type shown operates at speeds in the order of one hundred twenty to one hundred fifty reciprocal strokes of the ram 42 per minute so as to carry out an equivalent number of can body forming and stripping operations per minute a minimum of two or more per second. Furthermore, during the stripping operations, the thin-walled can bodies 46 can be stripped from the ram 42 without any appreciable malformation. The following trimming operations are likewise extremely precise operations and depend on final can bodies 46 exactly predictably formed and free of any malformations including malformations of the side walls 48 and open ends 50. For instance, if improper stripping takes place, a finished can body 46 could have curled portions at the open end 50 or the side wall 48 could be bulged or collapsed, any of which would result in a scrap can body.

More particularly to the principles of the present invention, it has been previously pointed out that the internal gaseous fluid stripper improvements are used as described herein as a stripping assist for the can bodies 46, that is, a stripping assist for the conventional external stripper 30. As shown, for instance in FIG. 5, the conventional external stripper 30 may include a usual frame 56 having a central, axial opening 58 and radially pivotally mounting a multiplicity of rearwardly directed fingers 60 normally resiliently urged radially inwardly to a can body engaging position by a coiled garter spring 62 which permits limited radially outward pivoting of the fingers. Briefly, therefore, as far as the external stripper 30 is concerned, as the ram 42 in its forward stroke exits the can body 46 now with its flat, semi-finished bottom wall 52 from the last of the wall ironing rings 28 and carries the can body through the external stripper opening 58, the fingers 60 are forced outwardly by the can body to permit passage therethrough and to ultimately permit the ram to force the can body against the doming die 32 forming the recessed, finished bottom wall 54 of the can body. As the ram 42 reverses and starts its rearward stroke, the external stripper fingers 60 having pivoted back inwardly after passage of the can body 46, the ram carries the can body back to the external stripper fingers where the fingers engage the can body open end 50 around the periphery of the ram stopping the can body so that continued rearward movement of the ram strips the can body therefrom.

From external appearance, the ram 42 is of usual appearance being cylindrical and having the can body 46 positioned over an end portion 64 thereof with the can body semi-finished or finished bottom wall 52 or 54 covering a ram end surface 66. The ram end surface 66 is formed with a central, axially inward recess 68 which cooperates with the doming die 32 to form the can body semi-finished bottom wall 52 into the can body finished bottom wall 54 as hereinbefore described.

Referring to FIGS. 5 through 8, a first embodiment of the internal gaseous fluid stripper of the present invention includes an axially elongated void or cavity 70 formed internally of the ram 42 terminating forwardly preferably relatively close to the ram end surface 66. The cavity 70 is connected forwardly communicating axially through the ram end surface 66 by a relatively large opening 72 sufficiently large to permit a relatively free flow of pressurized gas, such as air, from the cavity through the ram end surface while still not prohibitively disturbing the contour of the ram recess 68 for its function of cooperating with the doming die 32 to form the can body 46 from the flat bottom wall 52 to the recessed bottom wall 54. The cavity 70 is radially defined and closed by the side walls of the ram 42 and is rearwardly terminated by a radial partition 74.

In this particular embodiment of the present invention, the partition 72 is provided with a selectively removable plug 76 formed with a determined size orifice 78 axially therethrough. The orifice 78 is of relatively small maximum radial cross-section as compared to the radial cross-section of the cavity 70 and the ram forward opening 72 generally as shown. Axially rearwardly of the partition 74, the ram 42 is formed with a gas supply opening 80 which need only be slightly larger in radial cross-section than the orifice 78 and can be of any larger size extending axially rearwardly through the remainder of the ram 42 and being connected to a supply of pressurized gas from exterior of the ram in usual well known manner, such as by usual flexible tubing, not shown. Again in this particular embodiment of the invention, the pressurized gas supply is connected into the gas supply opening 80 for a constant flow of pressurized gas throughout normal continuous movement of the ram 42.

Figure 6:
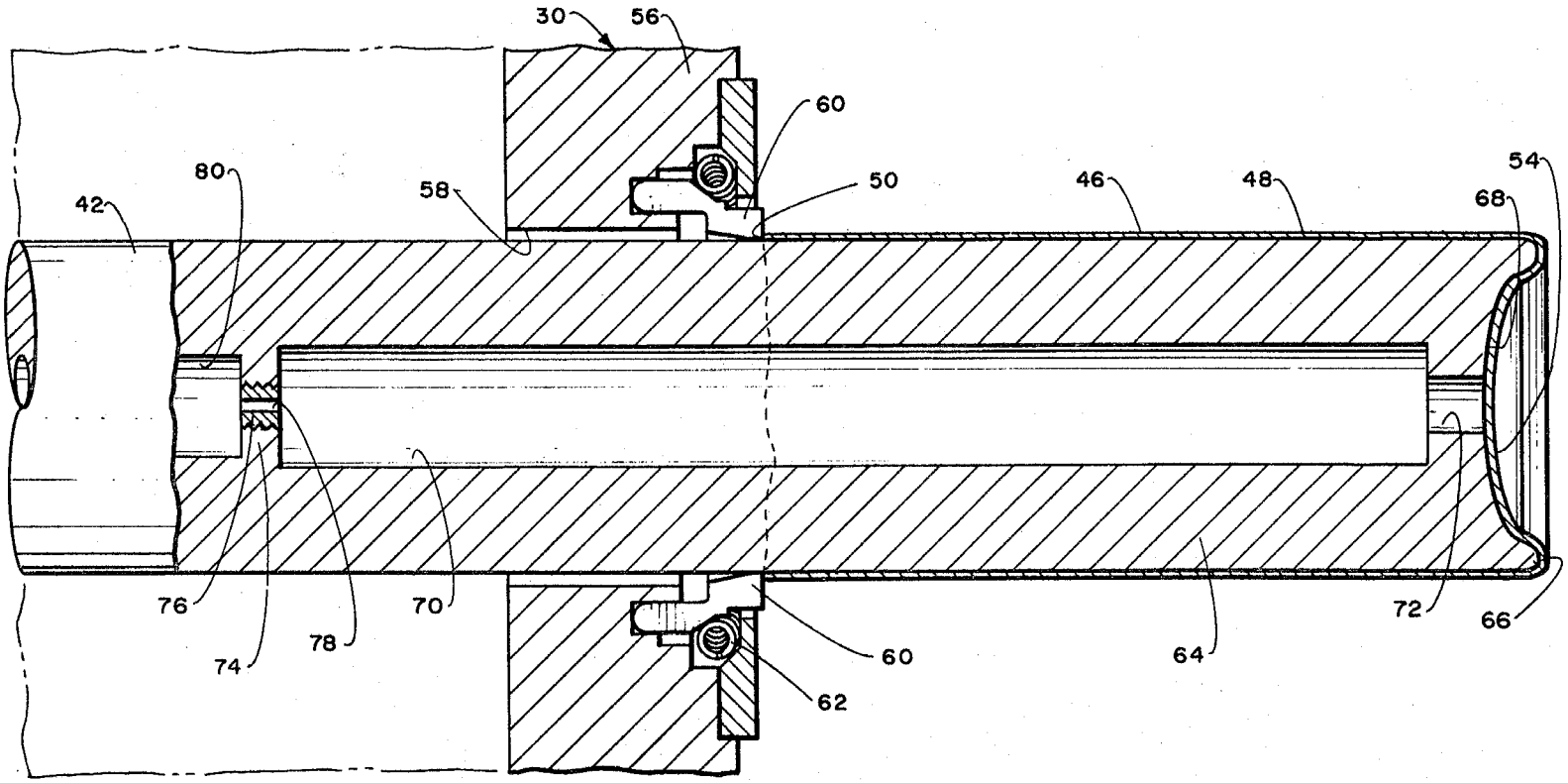
FIG. 6 is a view similar to FIG. 5 but with the ram in the initial portion of its rearward stroke after completion of the doming operation on the can body and with the ram positioned just engaging the open end of the can body with the external stripper to initiate the can body stripping operation.
Figure 7:
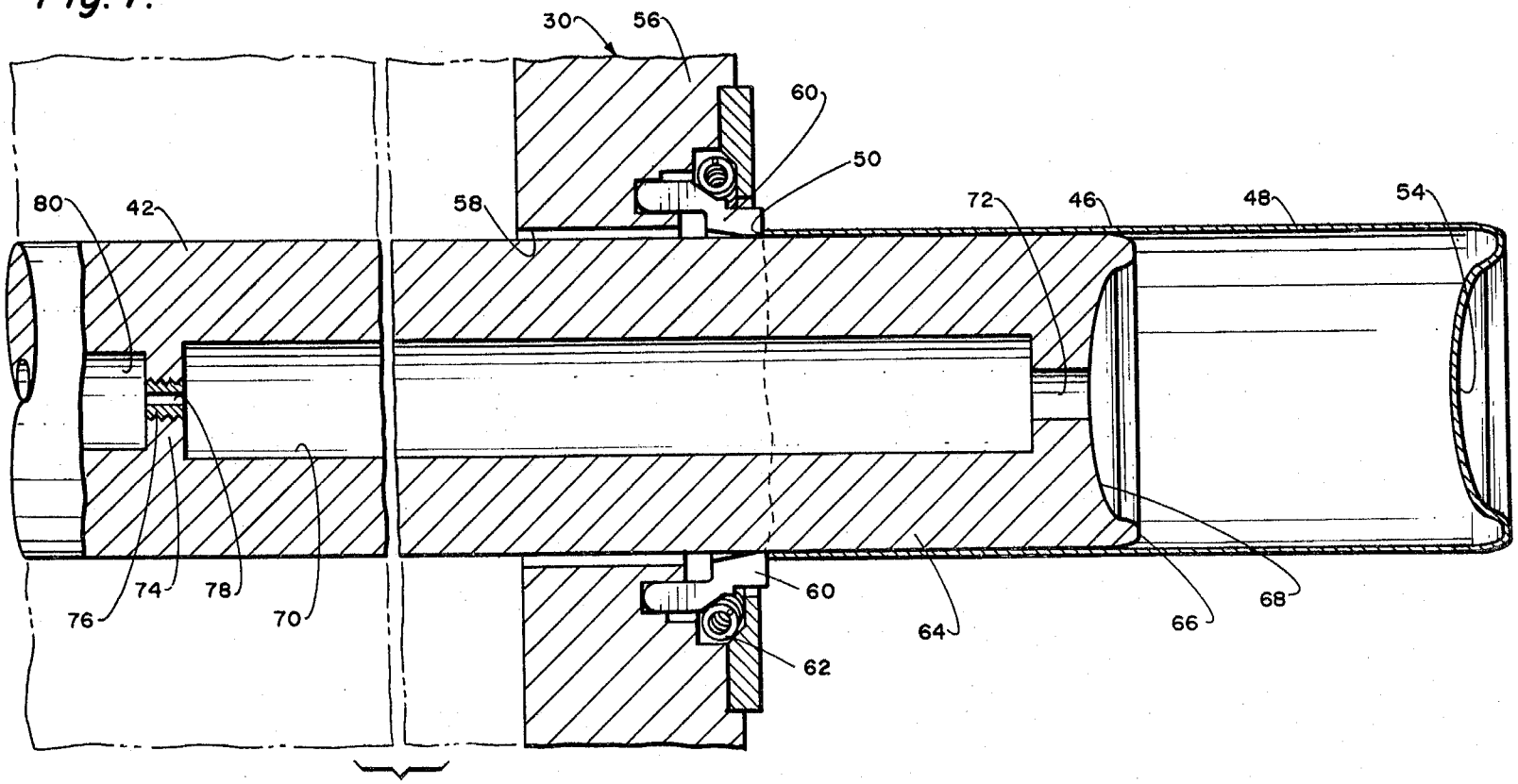
FIG. 7 is a view similar to FIG. 6 but with the can body intermediate the can body stripping operation.

The basic broad concept of the internal gaseous fluid stripper of the present invention and using the structure of the ram 42 just described, but at this time totally ignoring consideration of the orifice 78, is that a predetermined volume of pressurized gas, such as pressurized air, will be stored within the ram cavity 70 at a predetermined pressure markedly above atmospheric pressure at least just prior to commencement of stripping of the can body 46 from the ram end portion 64 such as shown in FIG. 6. At this time, the stored high pressure gas will be retained in the ram cavity 70 and against forward flow through the ram opening 72 solely by the now recessed bottom wall 54 of the can body 46 so that as the stripping of the can body 46 begins and progresses by the relative movement between the can body and the ram 42 as shown in FIG. 7, the stored high pressure gas in the ram cavity 70 will freely flow forwardly through the ram opening and forwardly of the ram end surface 66 distributing between the ram cavity and the progressively increasing exposed inner confines of the can body. Although the originally stored high pressure gas is still confined within the combination of the ram cavity 70 and the now exposed inner confines of the can body 46, the pressure of such gas through the greater combined volume of confinement will progressively decrease in pressure. Thus, by properly precalculating and proportioning the volume of the ram cavity 70, the total internal volume of the can body 46 and the pressure of the high pressure gas within the ram cavity just prior to commencement of the stripping operation, it is possible to maintain internal gas pressure against the can body gradually decreasing, but above atmospheric pressure, throughout the can body stripping and until the can body completely separates from the ram end portion 64, that is, immediately following the position shown in FIG. 8.

Assuming the static, stored high pressure gas in the ram cavity 70 just prior to commencement of stripping as stated in the foregoing basic broad concept, that is, the precalculated volume of pressurized gas not added to throughout the stripping operation, which can be easily accomplished by use of a pressure sensitive inlet valve in place of the orifice 78, and assuming that the contained pressure within the combined ram cavity 70 and internally of the can body 46 at the very instant of complete stripping is desired to be essentially atmospheric pressure, say fifteen pounds per square inch, the respective cavity and can body volumes can be easily related to a given pressure of high pressure gas above atmospheric pressure within the ram cavity just prior to the commencement of the stripping operation. For example, with the volume of the ram cavity 70 one-fifth of the internal volume of the can body 46 and the stored high pressure gas within the ram cavity just prior to the commencement of the stripping operation at ninety pounds per square inch, the total combined ram cavity and internal can body volume containing the gas just prior to completion of the stripping operation or just prior to complete separation of the can body from the ram will be six times the ram cavity volume alone which will reduce the gas pressure to fifteen pounds per square inch or atmospheric pressure. If it is desired that the final contained pressure of the gas immediately prior to completion of stripping just preceding the complete separation be at a predetermined pressure above atmospheric, this can likewise be relatively simply calculated and provided, for instance, by a calculated increase of the overall volume of the ram cavity 70 at the same contained gas pressure.

In the first preferred embodiment of the internal gaseous fluid stripper shown in FIGS. 5 through 8 and above described, however, the volume of the high pressure gas within the ram cavity 70 just prior to the commencement of the stripping operation is not a static volume, but with the orifice 78 constantly open into the ram cavity and a pressurized gas supply constantly being directed thereto even during the stripping operation, a relatively small amount of pressurized gas is added to the ram cavity during the stripping operation. This, of course, must be taken into account in determining the various volume sizes and gas pressures but likewise can be easily precalculated by those skilled in the art. Furthermore, with the first embodiment structure described including the orifice 78 and the constantly flowing pressurized gas supply directed thereto, an embodiment is provided having no moving parts, quite advantageous for operation over a long period of useful life.

In general operation of the can bodymaker of FIGS. 1 through 4 with the first embodiment of the internal gaseous fluid stripper of the present invention of FIGS. 5 through 8, in this case, acting as a stripping assist to the conventional external stripper 30, a relatively shallow, relatively large diameter, metallic can cup 38 having a wall thickness of twelve to fourteen thousandths of an inch is fed into the part positioning yoke 40 by the cup feed assembly 24 with the reciprocal ram 42 just completing its rearward or maximum withdrawal stroke. The redraw blankholder 44 moves forwardly into the can cup 38 positioning the can cup against the redraw die ring 26 as the ram 42 begins its forward stroke entering the redraw blankholder 44 and can cup 38, and engaging the ram end surface 66 against the bottom wall of the can cup 38, such can cup bottom wall being flat and in this same general flat condition ultimately becoming the flat semi-finished bottom wall 52 of the can body 46. As the ram 42 engages and abuts against the bottom wall of the can cup 38, it not only supplies an axial force against the can cup 38 to begin to remove the can cup from the redraw blankholder 44 and begin to carry the same through the redraw die ring 26, but most important relative to the present invention, the bottom wall of the can cup 38 seals off the ram recess 68 in the ram end surface 66 and thereby also forwardly seals off the ram opening 72 and the ram cavity 70.

With the supply flow of pressurized gas to the ram orifice 78 constantly flowing throughout movement of the ram 42, this sealing off of the ram end surface 66 by the can cup 38 immediately begins to trap the pressurized gas within the ram end surface recess 68 and the ram cavity 70 to begin to build up the gas pressure within such recess and cavity. This build up of the pressurized gas within the ram end surface recess 68 and the ram cavity 70 is relatively slow due to the restricted size of the ram orifice 78 relative to the radial cross-sectional sizes of the recess and cavity, but is continued to be confined by the can cup 38 during the following forward movement of the ram 42 in continuation of its forward working stroke carrying the can cup progressively through the redraw die ring 26 and the following wall ironing rings 28 finally arriving at the external stripper 30 as shown in FIG. 5. At this point and with the ram 42 still in its forward stroke but approaching the latter stages thereof, the can cup 38 has been reformed into the can body 46 of greatly increased depth and reduced diameter tightly gripping the ram end portion 64 and having a wall thickness of approximately four thousandths of an inch, but still having the flat, semi-finished bottom wall 52 still confining the pressure build up of pressurized gas within the ram end surface recess 68 and the ram cavity 70.

As the ram 42 carries the can body 46 with its flat, semi-finished bottom wall 52 forwardly through the opening 58 of the external stripper 30, the can body engages and forces the external stripper fingers 60 to pivot radially outwardly as permitted by the spring 62 and the can body is carried by the ram forwardly against the doming die 32 which forms the flat, semi-finished bottom wall 52 of the can body into the recessed, finished bottom wall 54, the ram completing its forward stroke and beginning its opposite rearward stroke to carry the now finished can body back to the external stripper 30 to the position shown in FIG. 6. During the reforming of the bottom wall of the can body 46 into the recessed, finished bottom wall 54, such bottom wall now totally conforms to the ram end surface recess 68 so that during such formation, the pressurized gas being confined thereby is forced rearwardly from the ram end surface recess 68 through the ram opening 72 and into the ram cavity 70. If the ram cavity 70 were sealed off rearwardly at the radial partition 74 a certain increase in gas pressure within the cavity would take place due to the elimination of the volume of the ram end surface recess 68, but with the supply of pressurized gas constantly flowing through the ram orifice 78 as before described, any consequent gas pressure build up may be somewhat less since, depending on the then pressure build up of the confined gas within the ram cavity relative to the pressure of the inlet gas supply, some pressurized gas can flow rearwardly through the ram orifice although, again, such flow would be relatively slow due to the restricted nature of the ram orifice.

Thus, as the ram 42 in its rearward return stroke carries the now finished can body 46 back to the external stripper 30 and the can body open end 50 begins its engagement with the now radially inward pivoted stripper fingers 60 to commence the stripping operation as shown in FIG. 6, the pressurized gas within the ram cavity 70 is at a predetermined pressure markedly above atmospheric pressure and is properly related or proportioned to the relationship or proportioning between the respective volumes of the ram cavity 70 and the can body 46. As the ram 42 continues in its rearward stroke withdrawing through the external stripper 30, the external stripper fingers 60 stop axial movement of the can body 46 beginning relative axial movement between the ram and can body. Furthermore, the forces created by the external stripper 30 and the high pressure gas confined within the ram cavity 70 against the can body finished bottom wall 54 freely through the ram opening 72 combine to create the initially difficult "break" of the can body 46 from the ram 42 progressively followed by the continued stripping or relative motion between the can body and ram due to the ram continued rearward withdrawal stroke movement.

As the stripping of the can body 46 from the ram 42 continues, increasing portions of the can body interior are exposed to the pressurized gas within the ram cavity 70 as shown in FIG. 7 and the pressurized gas originally totally confined within the ram cavity flows through the ram opening 72 into the inner confines of the can body to distribute therebetween, but with the gas pressure calculated to remain above atmospheric pressure substantially throughout the stripping operation, the pressurized gas continues to exert a now progressively decreasing internal force against the can body 46. At the same time, depending on the inlet pressure of the gas supply to the ram orifice 78 and with the gas supply continuous and the ram orifice constantly open, although restricted, there will be a slight additional inflow of pressurized gas through the ram orifice into the ram cavity 70 during the overall stripping operation. Again, such additional pressurized gas added to the ram cavity 70 during the stripping operation can be relatively easily precalculated by those skilled in the art taking into account all of the factors involved including the inlet pressure of the gas supply, the size of the ram orifice 78, the initial and progressive decrease of the pressure of the gas originally stored and confined within the ram cavity 70 and the speed of the stripping operation which would be dependent on the lineal speed of the ram 42 during the stripping operation.

Figure 8:
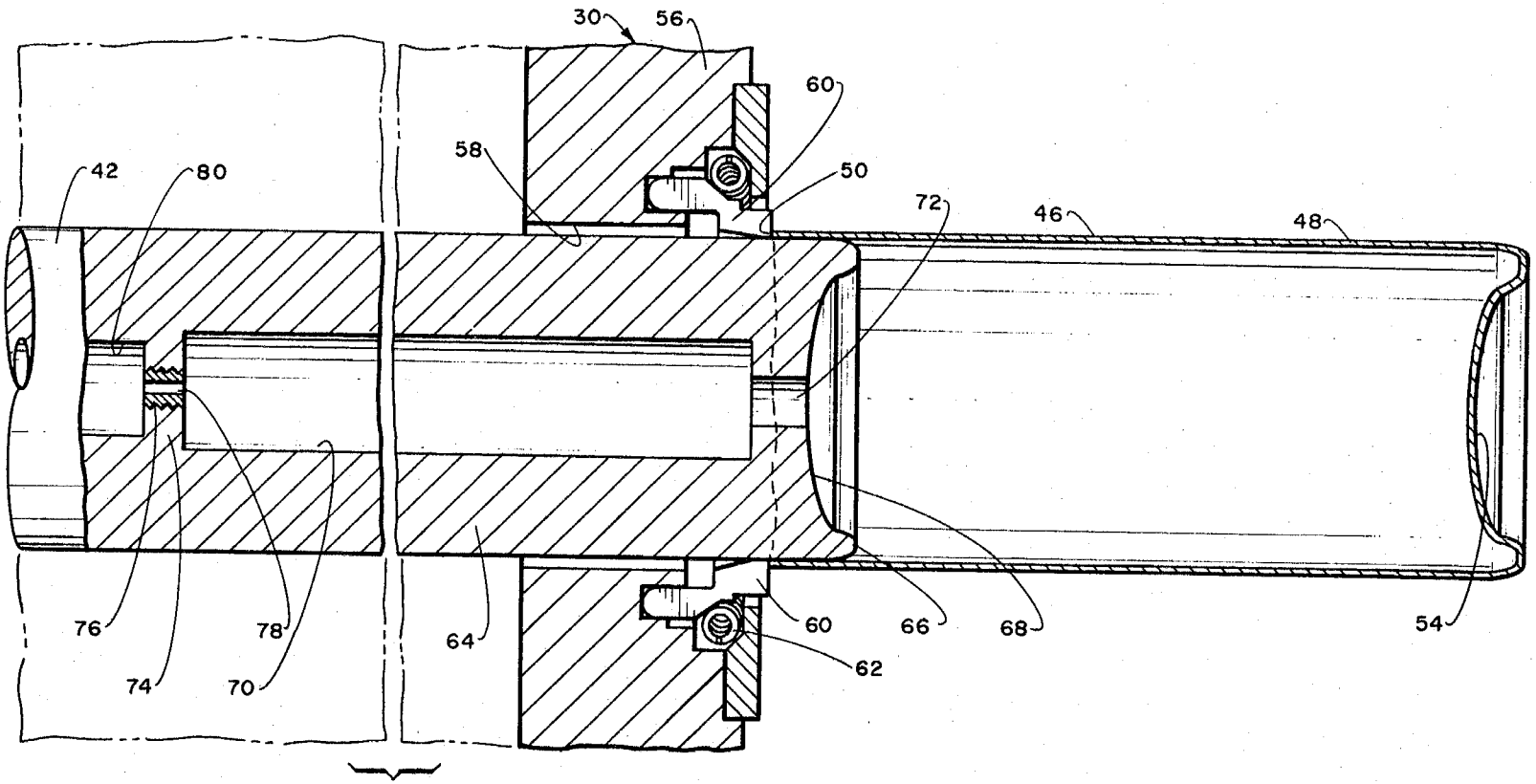
FIG. 8 is a view similar to FIG. 7 but with the can body nearly completely stripped from the ram.

Completing such stripping operation, the ram 42 progresses to its position of nearly complete withdrawal in its rearward stroke from the can body 46 as shown in FIG. 8 and at this stage, the pressure of the confined gas within the can body 46 and the ram cavity 70 will be approaching atmospheric pressure or any reasonable pressure above atmospheric pressure desired as precalculated. The position of FIG. 8 will be immediately followed by complete separation of the can body 46 from the ram 42 and if the final calculated internal gas pressure is substantially atmospheric pressure, the can body will merely drop downwardly to an appropriate conveyor as hereinbefore described, whereas, if the precalculated internal gas pressure is above atmospheric pressure, the can body will be slightly projected from the external stripper 30 toward the doming die 32 and then fall downwardly to the conveyor. The complete cycle of the can bodymaker is completed by the ram 42 continuing and completing its rearward return stroke followed by reversal to start its next forward working stroke and ready to engage the next can cup 38 for a repeat of the entire cycle.

As hereinbefore discussed, it is important that the confined gas pressure within the mutual confinement of the can body 46 and the ram cavity 70 at the completion of the stripping operation when the can body finally separates from the ram 42 be not lower than substantially atmospheric, that is, not lower than approximately twelve or thirteen to fifteen pounds per square inch, since the drawing of any appreciable vacuum within the can body 46 will create the extreme danger of collapse of the can body resulting in an unusable scrap part. Also, if any appreciable vacuum is drawn within the can body 46 during stripping, even ignoring the extreme dangers of can body collapse and particularly with the thin wall thicknesses thereof augmenting these dangers, such vacuum must necessarily be counteracted by the action of the external stripper 30 presenting the further danger of a scrap part resulting from prohibitive curling or distortion of the can body open end 50 by the external stripper fingers 60. The amount of calculated internal gas pressure internally of the can body 46 above atmospheric pressure at the instant of complete stripping will be limited by the degree of ejection of the can body 46 from the ram 42 that can be tolerated by the open axial distance between the external stripper 30 and the doming die 32 as well as the positioning of the conveyor therebeneath. Although there is also the danger of distorting the can body 46 by bulging from excessive internal gas pressure, sufficient ejection force of the can body from the ram 42 causing the can body to strike the doming die 32 with any appreciable force or even at all normally cannot be tolerated. All of this, however, can be easily controlled by proper, relatively simple precalculation as hereinbefore described and, in most cases, it would be preferred for optimum results to properly precalculate so that the internal gas pressure within the can body 46 at the instant of complete stripping from the ram 42 would be a few pounds per square inch above atmospheric pressure, totally eliminating the dangers of can body vacuum collapse, as well as excessive ejection of the can body from the ram 42.

As a practical example of the use of the first embodiment of the internal gaseous fluid stripper of the present invention as hereinbefore described and shown in FIGS. 5 through 8, a bodymaker was used operating at a ram speed of one hundred-twenty cycles per minute or two complete cycles per second and using can cups 38 formed of tinplate and wall thicknesses of twelve to fourteen thousandths of an inch. These resulted in can bodies 46 an average of approximately five and one half inches long having wall thicknesses of four thousandths of an inch and internal volumes of about 28 cubic inches. The ram cavity 70 had a volume of six cubic inches, the ram orifice 78 has sixty thousandths of an inch in diameter and the input gas supply pressure, in this case air pressure, was ninety pounds per square inch. The maximum stored or confined air pressure at commencement of stripping of the can body 46 within the ram cavity 70 was approximately eighty three pounds per square inch and the final confined air pressure within the can body at the instant of completion of stripping was approximately one to two pounds per square inch above atmospheric pressure.

A second preferred embodiment of the internal gaseous fluid stripper of the present is shown in FIGS. 9 through 13 and is substantially identical to the first embodiment just described with the addition of a rearward flow check valve generally indicated at 82 axially adjustably positioned intermediate the ram cavity 70. In the first embodiment above described, the ram cavity 70 is unobstructed axially forwardly of the ram orifice 78, there being nothing to prevent the free forward flow of pressurized gas forwardly through the cavity and from the ram opening 72 except the confining by the can body 46, but the same is also true as to rearward pressurized gas flow rearwardly to the orifice 78. In this second embodiment, the check valve 82 still permits unobstructed free flow of pressurized gas from the ram orifice 78 forwardly through the ram cavity 70 and from the ram opening 72, but any rearward gas flow from a forward cavity portion 84 rearwardly through the check valve to a rearward cavity portion 86 is sealed off and prevented automatically by the check valve.

More particularly, the check valve 82 includes a radially extending frame 88 with preferably four equally circumferentially spaced and axially extending gas flow openings 90 formed therethrough. The gas flow openings 90 are normally covered at the forward cavity portion side of the frame 88 by a resilient closure disc 92 which is secured flat-wise against the frame by a central fastener 94. The frame 88, in turn, is threadably secured positioned across the ram cavity, such threadable securement permitting adjustment of the frame and, therefore, the entire check valve 82 forwardly and rearwardly selectively along the ram 42 to thereby adjust the respective sizes of the ram forward and rearward cavity portions 84 and 86.

Figure 9:
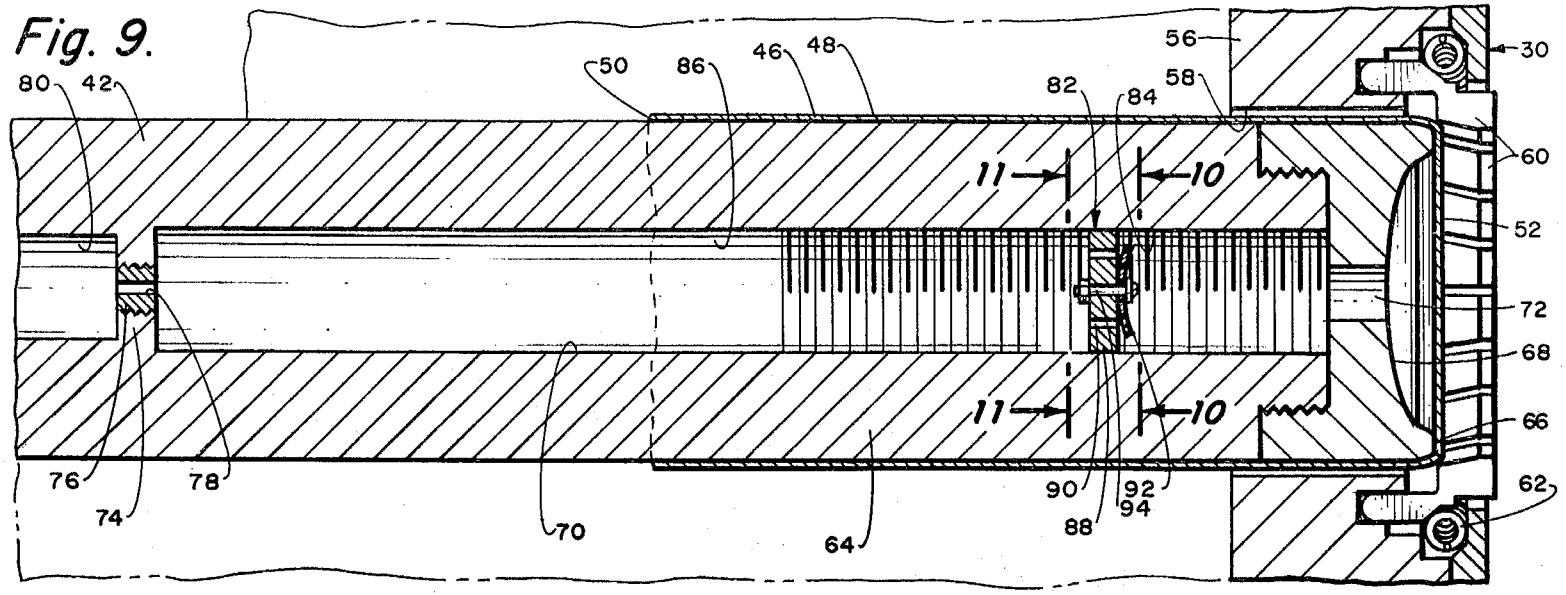
FIG. 9 is a view similar to FIG. 5 but with the ram incorporating a second preferred embodiment of the internal gaseous fluid stripper of the present invention.
Figure 11:
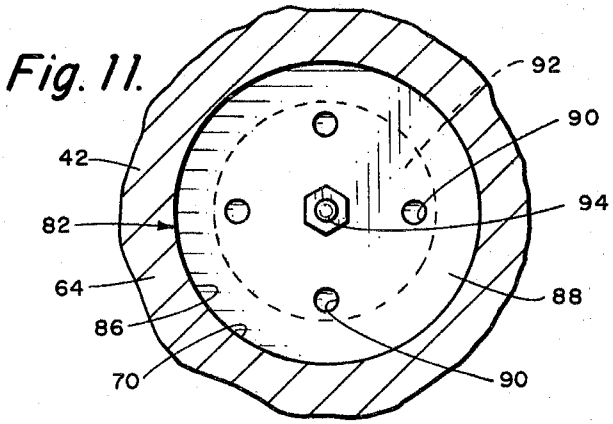
FIG. 11 is an enlarged, fragmentary, vertical sectional view looking in the direction of the arrows 11—11 in FIG. 9.
Figure 10:
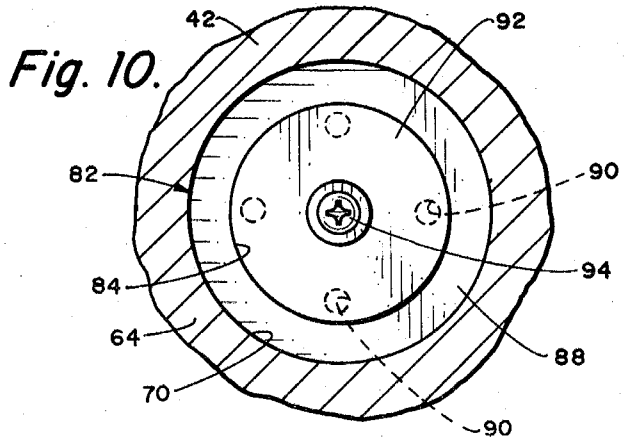
FIG. 10 is an enlarged, fragmentary, vertical sectional view looking in the direction of the arrows 10—10 in FIG. 9.

In an example of use of this second embodiment having the additional check valve 82 and assuming that the check valve is selectively axially adjusted along the ram cavity 70 so that the forward cavity portion 84 is approximately equal in volume to the recess 68 in the ram end surface 66, FIG. 9 shows the ram 42 in its forward working stroke wherein the ram cavity is being filled through the ram orifice 78 with pressurized gas, such pressurized gas freely distributing forwardly through the gas flow openings 90 of the check valve 82 filling both the forward and rearward cavity portions 84 and 86 by forcing the check valve closure disc 92 to flex peripherally forwardly. This likewise means that the pressurized gas will flow freely forwardly through the ram opening 72 and distribute freely within the ram end surface recess 68 as confined by the still flat, semi-finished bottom wall 52 of the can body 46. Such free forward flow of the pressurized gas through the check valve 82 will continue until the ram 42 completes its forward working stroke forcing the can body 46 against the doming die 32 and reforming the flat, semi-finished bottom wall 52 of the can body into the recessed, finished bottom wall 54. As shown by comparison of FIGS. 9 and 12 before and after the doming operation, the doming operation eliminates the volume of the ram end surface recess 68 forcing the pressurized gas formerly therein back or rearwardly into the ram forward cavity portion 84.

Figure 12:
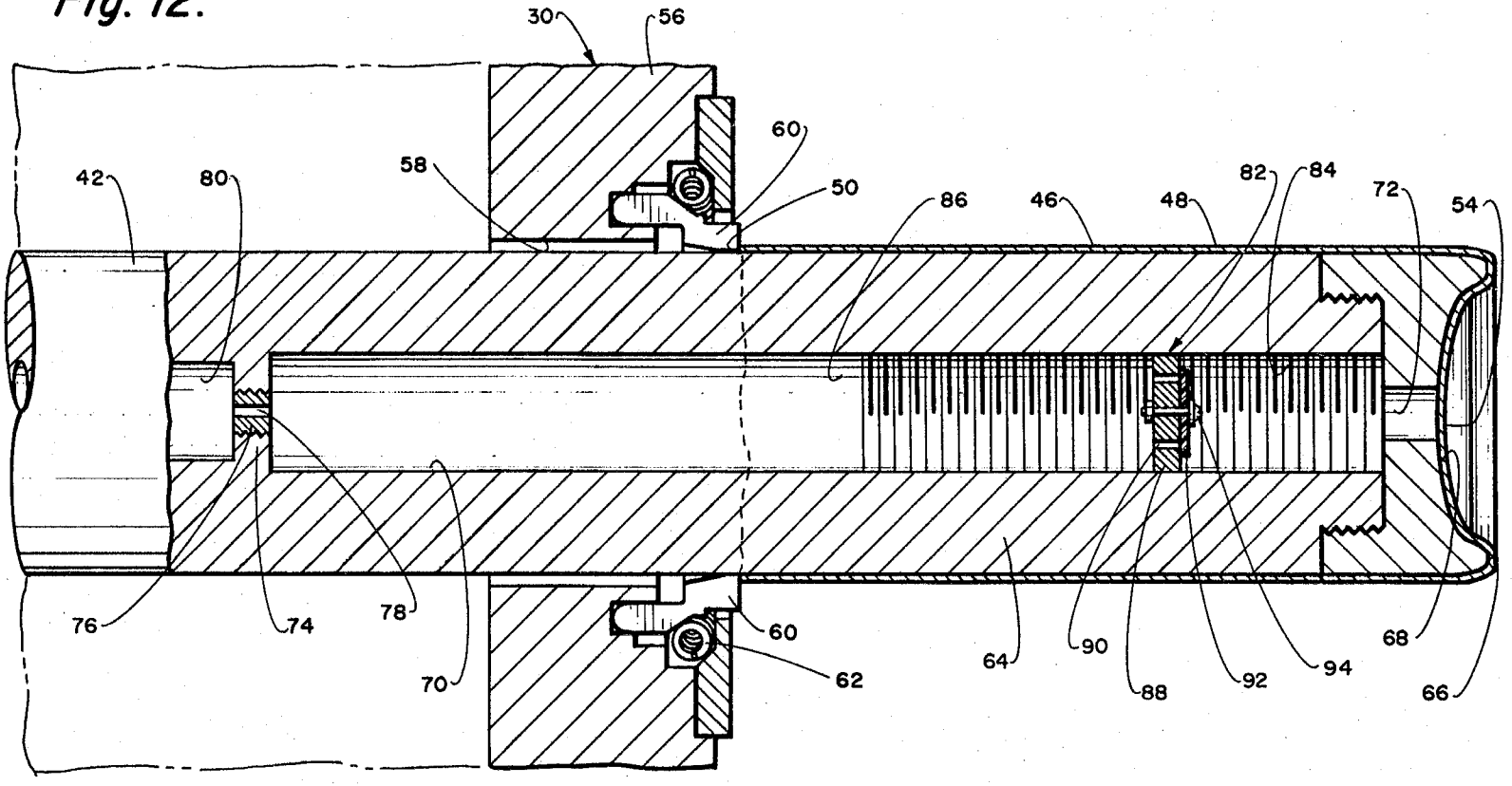
FIG. 12 is a view similar to FIG. 9 but with the ram positioned just at initiation of the stripping operation.
Figure 13:
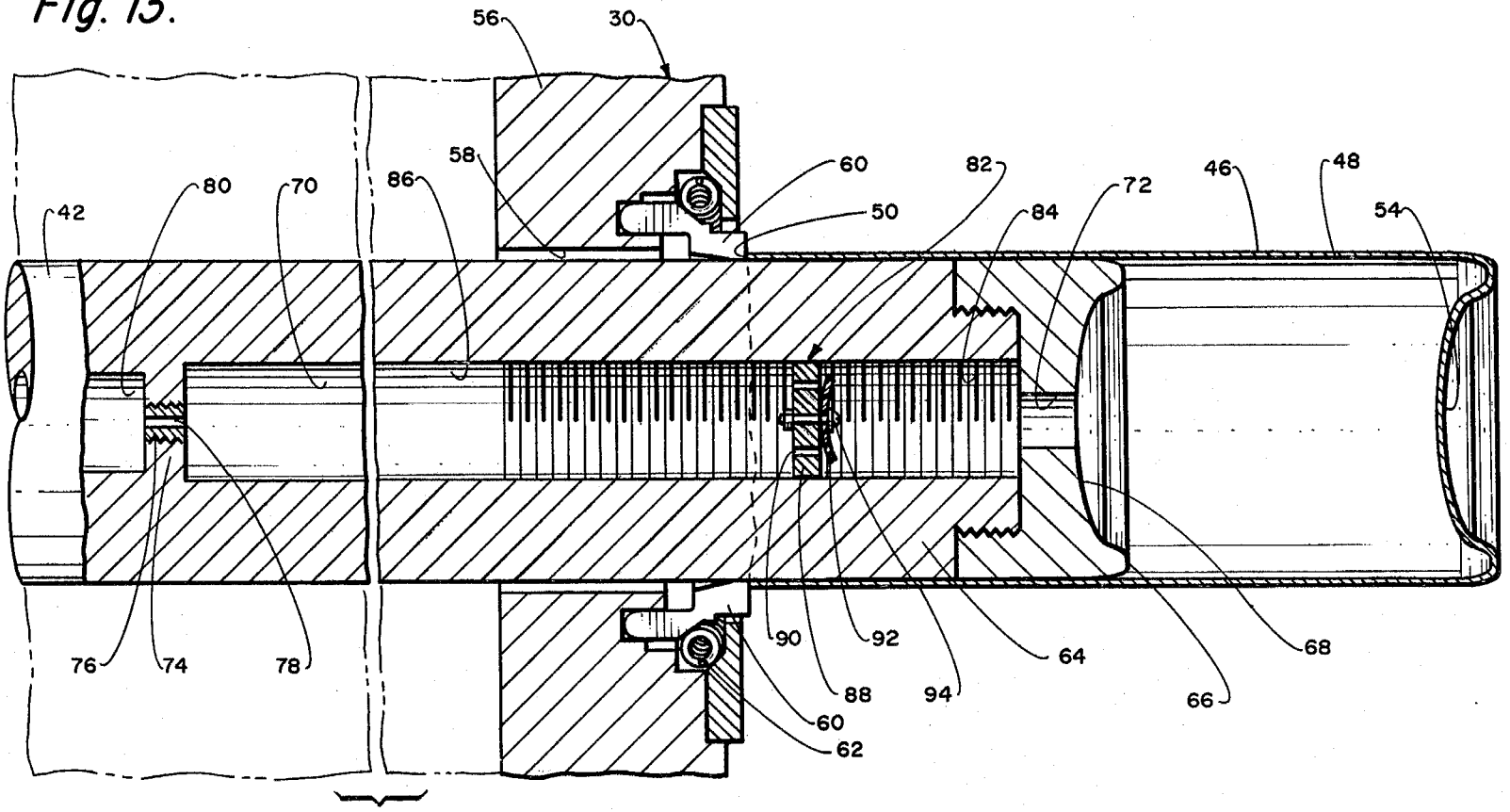
FIG. 13 is a view similar to FIG. 12 but with the can body intermediate the stripping operation.

Thus, following the doming operation and continuing through commencement of the stripping operation, the latter being shown in FIG. 12, the forced rearward flow of the pressurized gas from the ram end surface recess 68 has acted against the check valve closure disc 92 flattening the same rearwardly to cover and close the gas flow openings 90 of the check valve 82. Since the volume containing the pressurized gas in the ram forward cavity portion 84 and formally in the ram end surface recess 68 has been reduced solely to the ram forward cavity portion 84 or approximately by one half, the pressure of the gas now confined within the ram forward cavity portion will be approximately doubled awaiting the initiation of the stripping operation. As the stripping operation begins from the position shown in FIG. 12 toward the position shown in FIG. 13, therefor, this quite high pressure charge of pressurized gas confined within the forward cavity portion 84 of the ram 42 will provide a quite strong "break" force against the can body 46 and for a very short period thereafter during relative axial movement between the can body and ram. The high pressure force will only endure, however, until the recessed, finished bottom wall 54 of the can body 46 clears the ram end surface recess 68, at which time, the gas pressures within the ram forward and rearward cavity portions 84 and 86 will have once again equalized permitting continued forward flow of pressurized gas into the increasing inner confines of the can body 46 so that pressurized gas will flow freely forwardly through the ram cavity 70 including forwardly through the now open check valve 82 as shown in FIG. 13 resulting in the same precalculated confined gas pressure substantially above atmospheric pressure at the end of the stripping operation as described relative to the first embodiment.

Thus, in use of this second embodiment of the internal gaseous fluid stripper of the present invention, an initial high pressure charge of pressurized gas is provided to supply an initial high force during the critical "break" period at commencement of the stripping operation. This high pressure force is only of a quite limited determined duration so that the pressure of the confined gas at the end of the stripping operation during separation of the can body 46 from the ram 42 is still completely controlled to the desired amount, particularly not substantially lower than atmospheric pressure. It is apparent that this second embodiment construction is particularly beneficial for stripping can bodies 46 formed of materials and/or of sizes which normally present difficulties in such stripping. Furthermore, with the check valve 82 selectively movable axially along the ram cavity 70 to a multiplicity of determined positions, the volume size of the ram forward cavity portion 84 may be reduced or increased to proportionately increase or reduce the pressure of the gas initial high pressure charge, thereby effectively regulating the initial high pressure force resulting therefrom to the actual degree of initial "break" difficulty involved in a particular stripping operation.

According to the principles of the present invention, therefore an internal gaseous fluid stripper for stripping cup-shaped articles from rams is provided wherein a predetermined volume of high pressure gas markedly above atmospheric pressure is stored internally of the ram in free forward flow communication with the interior of the article to be stripped from the ram and confined against free forward flow from the ram solely by the article awaiting commencement of the stripping operation. The free flow of the predetermined volume of high pressure gas remains at all times unobstructed against forward flow within the ram and internally into the article throughout the stripping operation so that during the stripping operation with the ram moving relative to the article, the initial volume of high pressure gas may freely distribute between its confinement in the ram and the increasing internal volume portions of the article to create a constant internal force agains the article creating or at least aiding in the relative stripping motion. By predetermining the initial volume of the high pressure gas within the ram at commencement of the stripping operation and the initial pressure thereof properly proportioned to the total internal volume of the article to be stripped from the ram, the decreasing gas pressure within the progressively increasing combined volumes of the ram and article may be closely regulated to be not substantially below atmospheric pressure at termination of stripping and, if desired, at any reasonable pressure above atmospheric pressure which may be predetermined. The overall result is an efficient overall stripping operation of a closely regulated nature with a minimum of added ram structure, while still avoiding all of the dangers of damage to the article normally involved with prior internal strippers as hereinbefore discussed.

It is pointed out that in applying the principles of the internal gaseous fluid stripper of the present invention to a particular article stripping operation, it is immaterial whether or not the original charge or volume of high pressure gas within the ram at the initiation of the stripping operation is a static volume of high pressure gas, that is, not added to during the stripping operation, or is such that a precalculated gas volume is added thereto during the actual stripping motion. In either case, the overall gas volume used during the stripping operation is relatively easily precalculated and the overall result is precisely the same. The important principle is that the pressurized gas within the ram will always be in free forward flow communication without any appreciable forward flow obstruction with the interior of the article at initiation of and throughout the stripping operation and will provide a positive force against the article being stripped throughout substantially the entire stripping operation.

I claim:

1. In a method of stripping a cup-shaped article after certain manufacturing operations thereon from an end portion of a reciprocal ram; the steps of: establishing a permanent gas containment void of preset total volume in said ram permanently open forwardly through a ram end surface; filling said void with gas supplied at an original determined pressure above atmospheric; confining said gas in said void against forward flow therefrom at least immediately prior to stripping solely by said article in finished form ready for stripping over said ram end; without in any way altering said void volume and its being permanently open forwardly through said ram end surface throughout stripping, progressively flowing at least said void gas into increasing exposed size inner confines of said article during progressive stripping of said article from said ram; by preselecting said supplied gas original determined pressure relative to said void and article volumes, maintaining said gas pressure progressively reducing but above atmospheric throughout said article stripping and finally reduced not substantially lower than atmospheric at the instant of completion of said stripping.

2. In a method of stripping as defined in claim 1 in which said step of filling said void with said gas includes relatively slowly filling said void at a relatively restricted flow rate with said gas at said original determined pressure above atmospheric.

3. In a method of stripping as defined in claim 1 in which said step of filling said void with said gas includes relatively slowly filling said void through an orifice of restricted size relative to said void preset total volume.

4. In a method of stripping as defined in claim 1 in which said step of filling said void with said gas includes supplying said void for said filling with pressurized gas at a relatively restricted flow rate relative to said void preset total volume for a period prior to and throughout the entire of said article stripping.

5. In a method of stripping as defined in claim 1 in which said step of filling said void with said gas includes filling said void and an article internal volume part forwardly of said ram end portion with said gas; and in which said method includes the steps of initially confining said gas in said void and said article internal volume part prior to an article end portion doming operation prior to said stripping, forcing said gas rearwardly from said article internal volume part and into said void by said article doming operation prior to said stripping.

6. In a method of stripping as defined in claim 1 in which said step of filling said void with said gas includes also initially filling an internal article space forwardly of said ram end portion with said gas prior to an article end portion doming operation; and in which said step of confining said gas in said void includes initially confining said gas in said void and said internal article space against forward flow therefrom prior to said article end portion doming operation, performing said article end portion doming operation substantially eliminating said internal article space forcing said gas of said space rearwardly into said void, restricting a front portion of said void to receiving said gas from said internal article space while retaining a rear portion of said void free of said gas from said internal article space thereby increasing pressure of said gas in said void forward portion over prior contained pressure thereof, maintaining relatively free forward flow communication of said gas in said void rearward portion and said gas in said void forward portion.

7. In a method of stripping as defined in claim 1 in which said method includes the step of during said progressive stripping of said article from said ram, engaging said article with an external stripper.

8. In a method of stripping as defined in claim 1 in which said step of filling said void with said gas includes supplying said void for said filling with pressurized gas at a relatively restricted flow rate relative to said void preset total volume for a period prior to and throughout the entire of said article stripping; and in which said method includes the further step of during said progressive stripping of said article from said ram, engaging said article with an external stripper.

9. In a method of stripping as defined in claim 1 in which said step of filling said void with said gas includes also initially filling an internal article space forwardly of said ram end portion with said gas prior to an article end portion doming operation; in which said step of confining said gas in said void includes initially confining said gas in said void and said internal article space against forward flow therefrom prior to said article end portion doming operation, performing said article end portion doming operation substantially eliminating said internal article space forcing said gas of said space rearwardly into said void, restricting a front portion of said void to receiving said gas from said internal article space while retaining a rear portion of said void free of said gas from said internal article space thereby increasing pressure of said gas in said void forward portion over prior contained pressure thereof, maintaining relatively free forward flow communication of said gas in said void rearward portion and said gas in said void forward portion; and in which said method includes the further step of during said progressive stripping of said article from said ram, engaging said article with an external stripper.

10. In a method of stripping a cup-shaped article after certain manufacturing operations thereon from an end portion of a reciprocal ram; the steps of: confining an originally preset volume of gas at an originally preset pressure above atmospheric in said ram against forward flow therefrom by said article in substantially final finished form over said ram end portion ready for stripping; without otherwise altering said forward flow confinement, permitting at least said originally preset volume of gas to relatively freely expand forwardly therefrom progressively into increasingly exposed inner confines of said article throughout stripping of said article from said ram end portion to exert pressure against said article for said stripping; by preselecting said gas originally preset pressure relative to said gas originally preset volume and total inner confine volume of said article, maintaining said gas under pressure above atmospheric freely flowing from said ram at least substantially to the end of said article stripping.

11. In a method of stripping as defined in claim 10 in which said step of confining said gas includes originally confining said gas prior to said article stripping by confining said gas partially within said article, then reducing the volume of said article prior to said stripping forcing said gas of said article rearwardly into said ram.

12. In a method of stripping as defined in claim 10 in which said step of confining said gas includes initially confining said gas prior to said article stripping by confining a portion of said gas partially in said article, then forming said article to final finished form to reduce volume thereof and force said article gas rearwardly into said ram prior to said article stripping, finally confining said gas within said ram prior to said article stripping part at one pressure and part at another pressure both above atmospheric and all of said gas freely forwardly flowable except for said article confinement.

13. In a method of stripping as defined in claim 10 in which said method includes the step of during said article stripping, engaging said article with an external stripper.

14. In a method of stripping as defined in claim 10 in which said article stripping takes place during a ram rearward stroke following a ram forward stroke; and in which said method includes the step of originally supplying said gas for said confining thereof at least during part of said ram forward stroke.

15. In a method of stripping as defined in claim 10 in which said article stripping takes place during a ram rearward stroke following a ram forward stroke; and in which said method includes the step of originally supplying said gas for said confining thereof at least substantially throughout said article being on said ram end portion prior to said article stripping.

16. In a method of stripping as defined in claim 10 in which said method includes the step of directing said gas into said ram for said confining thereof throughout movement of said ram.

17. In a method of stripping as defined in claim 10 in which said step of confining said gas includes originally confining said gas prior to said article stripping by confining said gas partially within said article, then reducing the volume of said article prior to said stripping forcing said gas of said article rearwardly into said ram; in which said article stripping takes place during a ram rearward stroke following a ram forward stroke; and in which said method includes the step of originally supplying said gas for said confining thereof at least during part of said ram forward stroke.

18. In a method of stripping as defined in claim 10 in which said article stripping takes place during a ram rearward stroke following a ram forward stroke; in which said method includes the step of originally supplying said gas for said confining thereof at least substantially throughout said article being on said ram end portion prior to said article stripping; and in which said step of confining said gas includes initially confining said gas prior to said article stripping partially within said article, then reducing the volume of said article to force said gas rearwardly into said ram prior to said article stripping.

19. In a method of stripping a cup-shaped article after certain manufacturing operations thereon from an end portion of a reciprocal ram; the steps of: confining an original volume of gas at a pressure above atmospheric in said ram by said article in substantially final finished form over said ram end portion ready for stripping; relatively freely distributing at least said original volume of gas between said confinement and increasingly exposed inner confines of said article throughout stripping of said article from said ram end portion to exert pressure against said article for said stripping; by preselecting said gas pressure relative to said gas original volume and total inner confined volume of said article, maintaining said gas under pressure above atmospheric to continue to exert pressure against said article at least substantially to the end of said article stripping.

20. In a method of stripping as defined in claim 19 in which said step of confining said gas in said ram includes constantly directing pressurized gas into said ram at a restricted flow rate relative to said original volume prior to and throughout said article stripping, preselecting said gas restricted flow rate so that any pressurized gas added to said original volume during said article stripping is of a determined amount added to said distribution of said original volume during said article stripping.

21. In a method of stripping as defined in claim 19 in which said step of confining said gas in said ram includes initially confining an initial volume of gas of greater volume as compared to said original volume, then reducing said confinement of said initial volume of gas to said original volume prior to said article stripping.

22. In a method of stripping as defined in claim 19 in which said step of confining said gas in said ram includes initially confining an initial volume of gas of greater volume as compared to said original volume, then reducing said confinement of said initial volume of gas to said original volume prior to said article stripping while raising the pressure of a determined part of said confined gas to a higher confined pressure with said higher confined pressure making up a part of said gas pressure at commencement of stripping.

23. In a method of stripping as defined in claim 19 in which said step of confining said gas in said ram includes directing pressurized gas into said ram for said confining during at least a major part of a forward stroke of said ram while said certain manufacturing operations are being performed on said article; and in which said method includes stripping said article from said ram during a ram rearward stroke.

24. In a method of stripping as defined in claim 19 in which said step of confining said gas in said ram includes directing pressurized gas at a slow rate relative to said original volume of said gas into said ram at least throughout presence of said article on said ram end portion and through completion of said article stripping.

25. In a method of stripping as defined in claim 19 in which said step of confining said gas in said ram includes initially confining an initial volume of gas of greater volume as compared to said original volume during a forward stroke of said ram, then at the end of said ram forward stroke and reversal for a ram rearward stroke reducing said confinement of said initial volume of gas to said original volume prior to ultimate article stripping during said ram rearward stroke while raising the pressure of at least a part of said confined gas to a higher confined pressure with said higher confined pressure making up at least a part of said original pressure.

26. In a method of stripping as defined in claim 19 in which said step of confining said gas in said ram includes directing pressurized gas into said ram for said confining during at least a part of a forward stroke of said ram while certain manufacturing operations are being performed on said article, initially confining an initial volume of gas of greater volume as compared to said original volume, then reducing said confinement of said initial volume of gas to said original volume prior to said stripping of said article from said ram; and in which said method includes stripping said article from said ram during a ram rearward stroke.

* * * * *